United States Patent [19]

Hogan

[11] 3,991,919

[45] Nov. 16, 1976

[54] TURNING MACHINES FOR PILLOW CASES AND SIMILAR ARTICLES

[76] Inventor: John Dennis Hogan, 18 Whitegates Road, Cheadle, Chester, England

[22] Filed: Oct. 3, 1975

[21] Appl. No.: 619,181

[30] Foreign Application Priority Data

Oct. 9, 1974 United Kingdom ..... 43715/74

[52] U.S. Cl. ..... 223/39

[51] Int. Cl.[2] ..... A41H 43/00

[58] Field of Search ..... 223/39–43

[56] References Cited

UNITED STATES PATENTS

| | | | |
|---|---|---|---|
| 2,520,200 | 8/1950 | Ersted | 223/39 |
| 3,310,207 | 3/1967 | Gore | 223/39 |
| 3,357,609 | 12/1967 | Oberrecht | 223/39 |
| 3,779,432 | 12/1973 | Fukuta et al. | 223/39 |

*Primary Examiner*—G. V. Larkin

*Attorney, Agent, or Firm*—Norris & Bateman

[57] ABSTRACT

A machine for turning pillowcases and similar articles comprises a conveyor for feeding a pillowcase to a table, a photo electric cell or cells for stopping the conveyor and positioning the pillowcase on the table from the first photo electric cell to the second, a presser foot and gripper arm for entering the open end of the pillowcase, an anchoring arm for clamping the forward end to the table, a pair of stretching and spreading arms over which the presser foot lifts the upper layer of the pillowcase while the lower layer is clamped to the table and a pair of arms engaging the pillowcase intermediate the stretching and spreading arms to move the trailing end of the pillowcase relatively to the open end to evert the pillowcase and upper arms to grip the closed end of the pillowcase and withdraw it from the stretching and spreading arms everted and right side out.

6 Claims, 12 Drawing Figures

FIG. 2

TURNING MACHINES FOR PILLOW CASES AND SIMILAR ARTICLES

This invention relates to improvements in turning machines for pillowcases and similar articles.

Pillowcases and similar articles may be formed with a captive flap adjacent an opening in the pillowcase or cover for enclosing an end of a pillow or the like articles, the sides of the flap being secured to adjacent sides of the pillowcase. Pillowcases and covers of this type are normally sewn together in an inside-out configuration whereby the raw edges of side seams are external when manufactured and internal in use. In this configuration the flap is in the form of a pocket over the opening of the pillowcase which hinders the operation of turning the pillowcase to the right side out configuration after the sewing operation.

The object of the invention is to provide a machine for turning pillowcases and similar articles of the type referred to right side out.

According to the invention a machine for everting pillowcases comprises a conveyor for feeding the pillowcases or similar articles to a table, a photo electric cell or cells for stopping the conveyor and positioning the pillowcases on the table, arms actuated to draw the pillowcase from the first photo cell to a second photo cell, a presser foot and gripper arms for entering the open end of the pillowcase, an anchoring arm for clamping the forward end of the pillowcase to the table, a pair of stretching and spreading arms over which the presser foot lifts the upper layer of the pillowcase whilst the lower layer is released from the table, a pair of arms engaging the pillowcase intermediate the stretching and spreading arms to move the trailing end of the pillowcase relatively to the open end to evert the pillowcase, and nipper arms to grip the closed end of the pillowcase and withdraw it from the stretching and spreading arms inverted and right side out.

The invention will be described with reference to the accompanying drawings.

Figure 1:
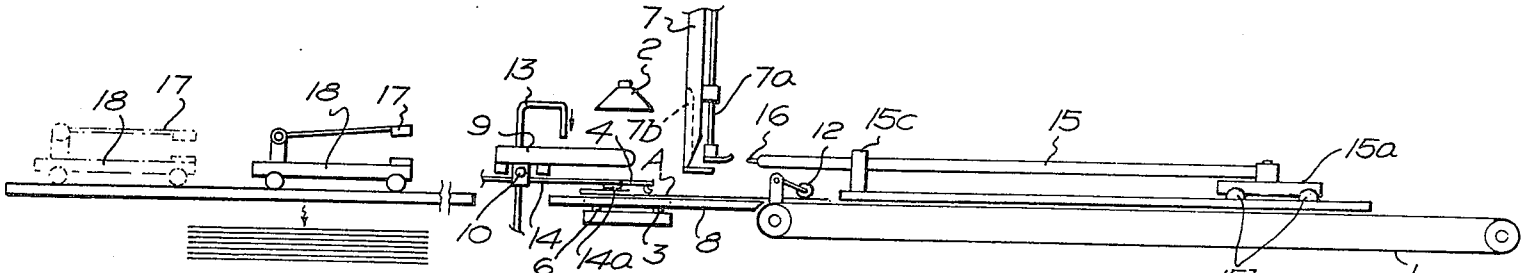
FIG. 1 is a side elevation of the machine.

A pillowcase A after sewing round the sides and the application of a flap *a* (if a flap is employed) is laid on a conveyor 1 wrong side out.

A pillowcase for turning or eversion is fed by the conveyor 1 to a table 8 on the machine. The pillowcase passes across a beam from a lamp 2 to mask the beam to a photo-electric cell 3 to energise a circuit to stop the conveyor and start a motor to cause a pair of arms 14 provided with a resilient pad 14*a* to fall onto the edges of the pillowcase. Rollers 12 are lowered into contact with the machine end of the pillowcase. A second pair of arms 4 arranged slightly above the pillowcase and having depending fingers 4*a* extend above the surface of the table over the pillowcase.

The arms 14 move forwardly and draw the pillowcase to mask a second beam to a second photo-electric cell 6 which, when the beam is masked, energises an electric circuit to stop the motor and the forward movement of the arm 14 with the pillowcase accurately positioned on the table.

A presser foot 7 and gripper arm 7*a* mounted above the table 8 are lowered onto the table rearwardly of the edge of the flap *a*, the presser foot 7 resting on the pillowcase on the table and being moved forwardly with the arms 4 to engage the flap *a* and carry it forward to a position just in advance of the forward edge of the pillowcase, the arms 4 preventing the flap from rising above the arms.

An arm 13 is lowered in front of the presser foot 7 onto the table to anchor the pillowcase thereon, the arm 13 engaging a slot 7*b* in the forward edge of the presser foot 7.

The fingers 4*a* prevent the flap from passing around the ends of the arms 13.

Figure 2:
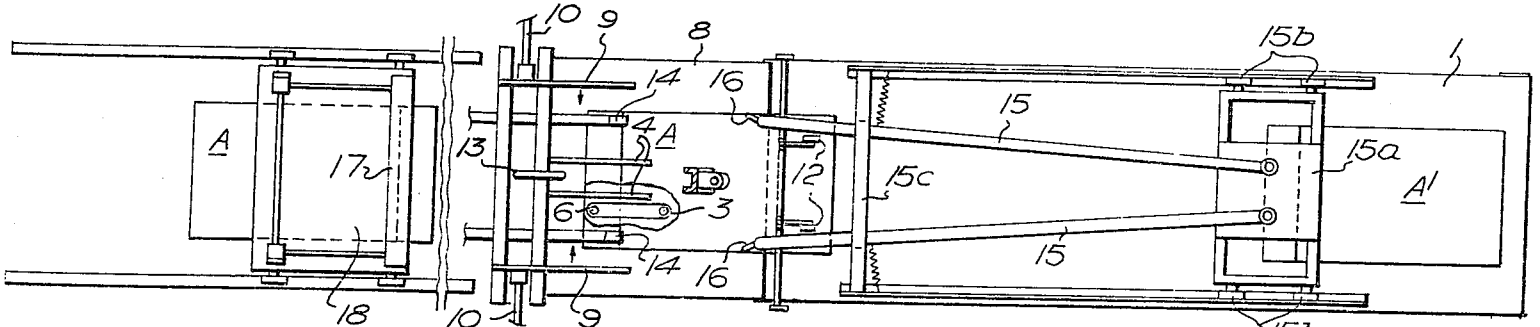
FIG. 2 is a plan of same.
Figure 3:
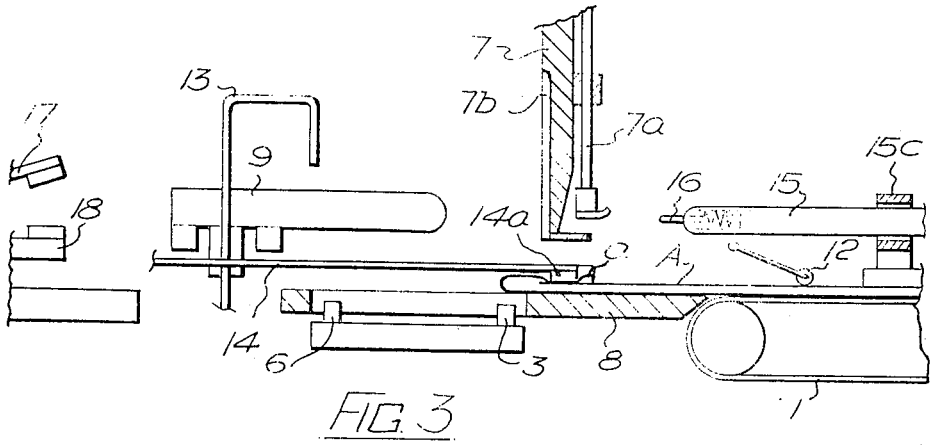
FIG. 3 is a detail side elevation showing a pillowcase arriving at the turning or eversion position.
Figure 4:
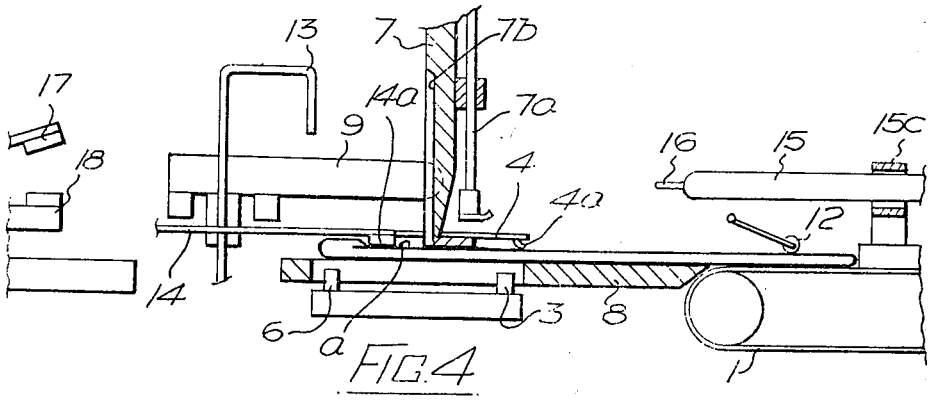
FIGS. 4, 5 and 6 are similar views showing the pillowcase open end in further positions during turning or eversion.
Figure 5:
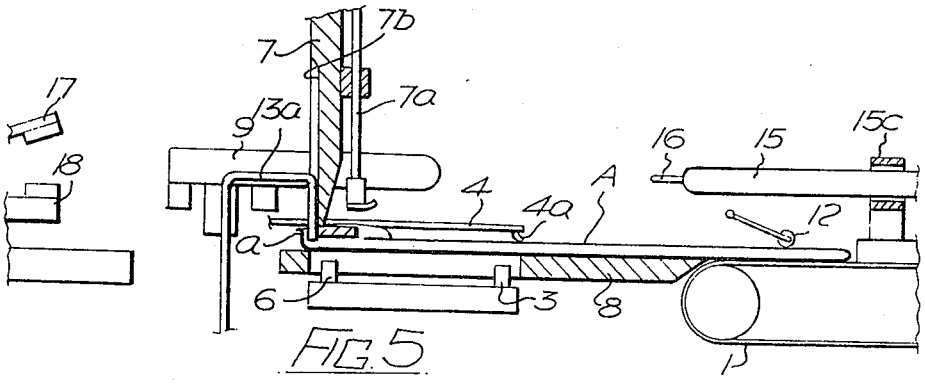
Figure 6:
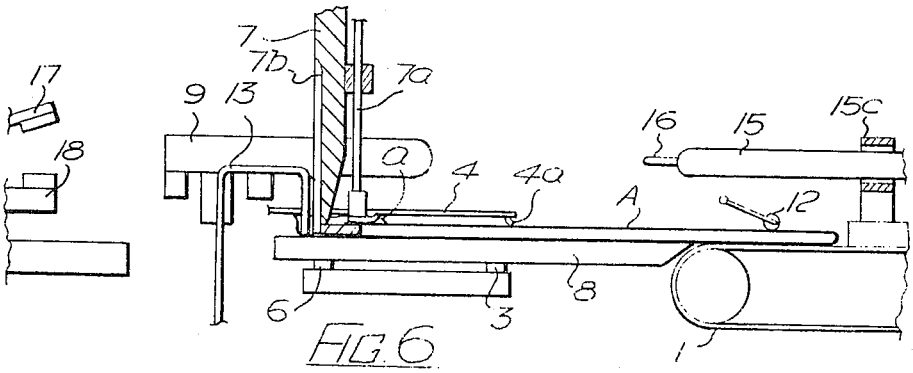
Figure 7:
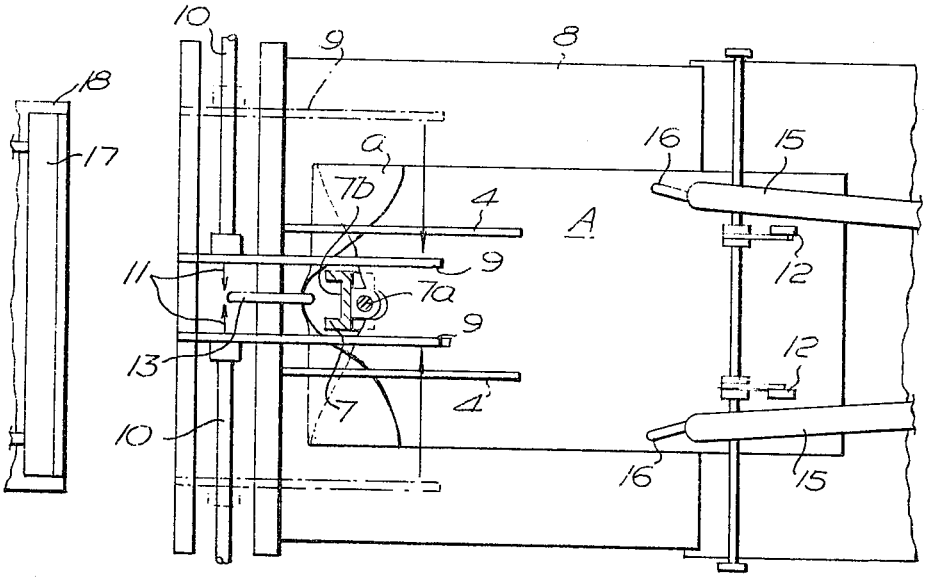
FIG. 7 is a plan view of FIG. 6.
Figure 8:
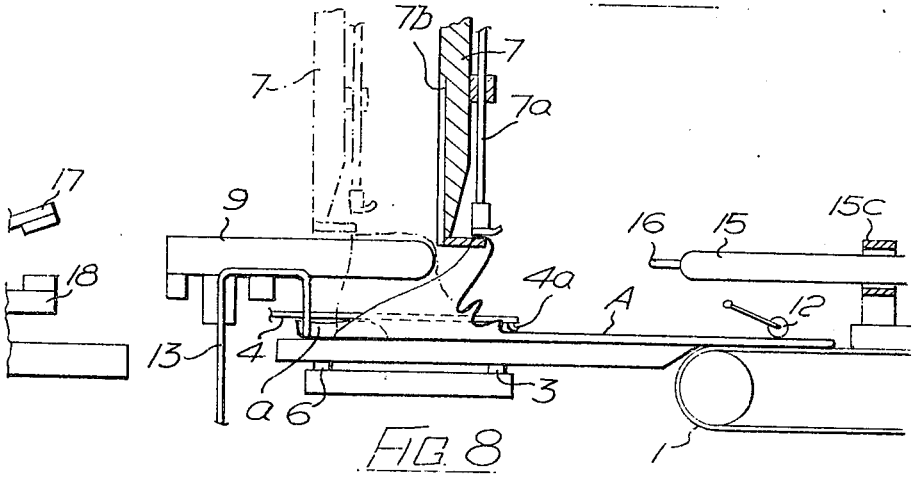
FIG. 8 is a similar view to FIG. 3 of a further position.
Figure 9:
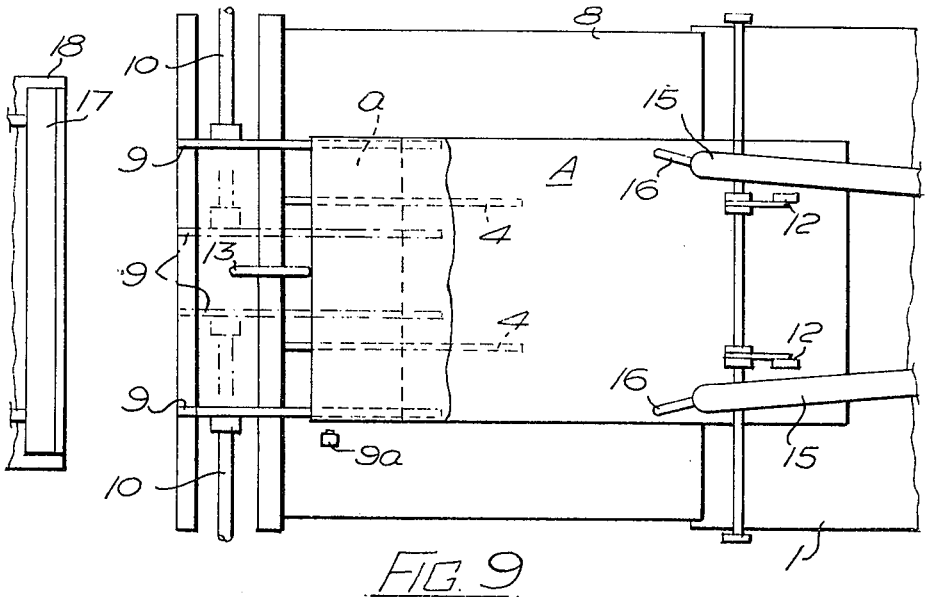
FIG. 9 is a plan of same.

The trailing end of the pillowcase is engaged by the rollers 12 carried by the conveyor 1 to maintain the pillowcase taut on the table, the presser foot 7 is moved rearwardly to enter the opening in the pillowcase (FIG. 8) and the gripper arm 7*a* is lowered to grip the upper layer of the pillowcase and anchor it to the presser foot. The presser foot 7 is then raised over a pair of stretching and spreading arms 9, each mounted on transverse rods 10 and positioned as shown in FIG. 2. The arms 9 move outwardly in the opposite direction to the arrows 11 (FIG. 7) to stretch and spread the pillowcase and the presser foot is then moved forwardly into the dotted position shown in FIG. 8 to draw the top layer of the pillowcase over the arms 9 which move further outwardly to tension the mouth of the pillowcase over the arms as shown in the dotted position in FIG. 8. At the same time, the arm 13 and the gripper arm 7*a* release the pillowcase and the free edge of the flap turns over the open end of the pillowcase. The conveyor is reversed momentarily and the rollers 12 take up any slack and are then raised from the pillowcase.

Figure 10:
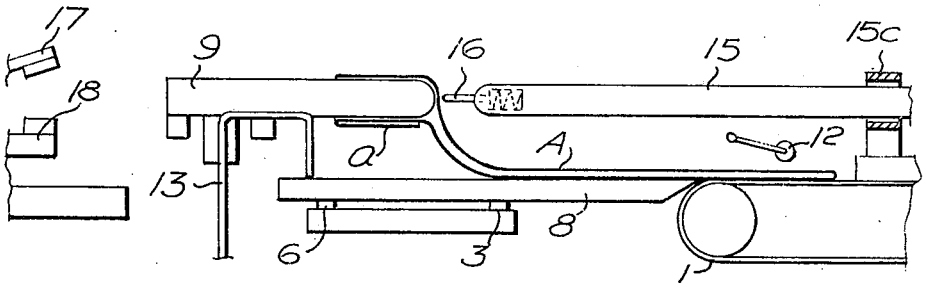
FIGS. 10–12 are further views showing further positions of the machine during turning or eversion.
Figure 11:
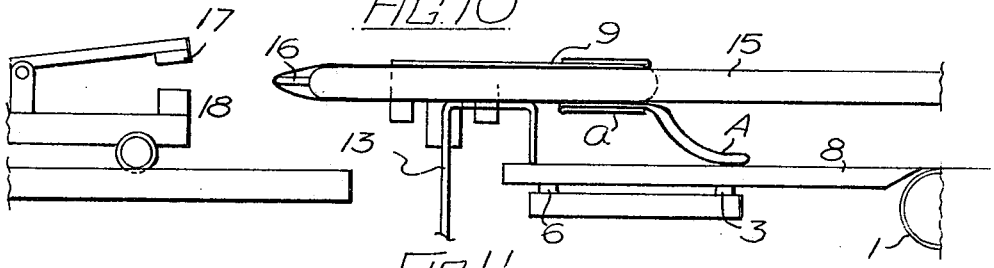
Figure 12:
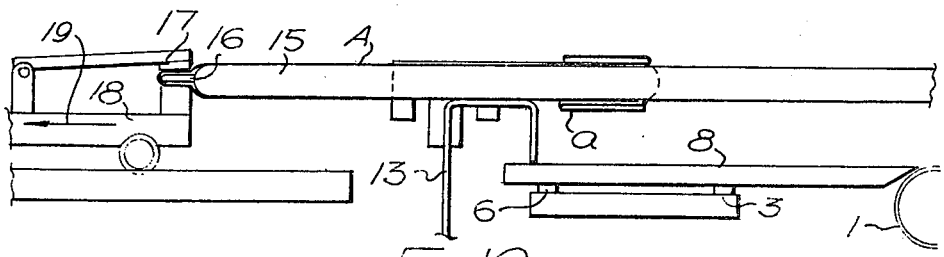

A pair of spring loaded arms 15, each formed at their free ends with a spring loaded peg 16 (FIG. 10) are moved forwardly to engage the pillowcase between the stretching and spreading arms 9 and carry the trailing end of the pillowcase past the open anchored end on the arms 9. The arms 15 continue to move forward until the pillowcase is everted or turned inside out with the pegs 16 in the closed corners thereof, to the position shown in FIG. 12. The arms 15 are mounted on a trolley 15*a* travelling on rollers 15*b* and supported by a transverse rail 15*c*.

A gripping arm 17 on a trolley 18 then lowers to grip the closed end of the pillowcase and the trolley 18 is moved forwardly in the direction of the arrow 19 (FIG. 12) to draw the pillowcase A off the stretching and spreading arms 9 which move inwardly to release the pillowcase. When the trolley 18 has reached the dotted position (FIG. 1) the arm 17 releases the pillowcase and it falls on to a pile below the trolley (FIG. 2).

As the pillowcase moves from over the photo-electric cell 3, the conveyor 1 is again started and a succeeding pillow $A^1$ thereon is moved into the eversion position and the cycle of operations is repeated.

During the removal of the turned pillowcase from the machine the arms 4, 9 and 14 and the presser foot 7 are returned to their initial positions for operation on a succeeding pillowcase $A^1$.

The arms 9 are metal and engage a contact 9*a* on the machine which is normally insulated therefrom by the pillowcase.

However, should presser foot 7 fail to enter the open mouth of the pillowcase, it will not be inserted over the arms 9 and the contact will engage the arms to operate a circuit to stop the machine.

If a pillowcase to be turned is not formed with a flap *a*, the arms 4 are not necessary and the mouth of the pillowcase is opened by the arms 14 to allow the presser foot to enter.

The arms and presser foot may be operated by cams or by hydraulic cylinders timed to actuate the mechanisms in sequence. The machine is capable of operating continuously to turn pillowcases and similar articles inside out and the term pillowcases used in the description and claims is general for similar articles including bolster cases, sacks and similar articles.

The embodiments of the invention in which an exclusive property or privilege is claimed are defined as follows:

1. A machine for everting pillowcases or the like comprising: a table; a conveyor for feeding pillowcases to said table; means for positioning a pillowcase on the table for eversion; gripping means on said table for engaging an upper layer of an open end of a pillowcase; anchoring means for clamping a lower layer of an open end of a pillowcase to said table; a pair of stretching and spreading arms over which said gripping means lifts an upper layer of an open end of a pillowcase as a lower layer thereof is released from said table; eversion means for moving the trailing end of a pillowcase through an open end of the same pillowcase between said stretching and spreading arms to evert a pillowcase; and nipper means for gripping a closed, everted end of a pillowcase and withdrawing it from the stretching and spreading arms.

2. A machine for everting pillowcases as in claim 1 further comprising signalling means responsive to the position of a pillowcase on said table for intermittently operating said conveyor to feed pillowcases to said table and for synchronizing operation of said means for positioning a pillowcase on the table for eversion with respect to operation of said conveyor.

3. A machine for everting pillowcases as in claim 1 further comprising fail safe means for stopping operation of said machine completely, said fail safe means comprising contact means between at least one of said stretching and spreading arms and a portion of said machine engageable to close a circuit for stopping said machine in the absence of a pillowcase thereover to insulate said contact means from one another.

4. A machine for everting pillowcases as in claim 1 wherein said eversion means comprise a pair of elongate arms, each having a forwardly projecting spring loaded peg therein, each peg being insertable between said nipper means with a portion of a closed, everted end of a pillowcase thereover whereby said nipper means may be closed to engage a pillowcase everted end and withdraw the same from said pegs.

5. A machine for everting pillowcases as in claim 1 further comprising a trolley for mounting said eversion means.

6. A machine for everting pillowcases as in claim 5 further comprising an additional, second trolley for mounting said nipper means.

* * * * *